US012263386B2

(12) United States Patent
Delmage

(10) Patent No.: US 12,263,386 B2
(45) Date of Patent: Apr. 1, 2025

(54) GOLF CUP CONSTRUCTION FOR USE WITH ARTIFICIAL TURF

(71) Applicant: Benjamin Delmage, Victoria (CA)

(72) Inventor: Benjamin Delmage, Victoria (CA)

( * ) Notice: Subject to any disclaimer, the term of this patent is extended or adjusted under 35 U.S.C. 154(b) by 603 days.

(21) Appl. No.: 17/186,153

(22) Filed: Feb. 26, 2021

(65) Prior Publication Data

US 2022/0273996 A1 Sep. 1, 2022

(51) Int. Cl.
*A63B 57/40* (2015.01)

(52) U.S. Cl.
CPC ..... *A63B 57/40* (2015.10)

(58) Field of Classification Search
CPC ..... A63B 57/40
See application file for complete search history.

(56) References Cited

U.S. PATENT DOCUMENTS 1,041,081 A * 10/1912 Hinckley ..... A63B 57/357 473/176
2,684,245 A * 7/1954 Jacoby ..... A63B 57/357 116/173
3,511,501 A * 5/1970 Sandberg ..... A63B 57/357 47/41.1
3,643,944 A * 2/1972 Boyes ..... A63B 57/40 473/175
5,427,371 A * 6/1995 Huston et al. ..... A63B 57/40 473/180
6,508,719 B1 * 1/2003 Reddick ..... A63B 69/3661 473/175
6,902,491 B2 * 6/2005 Barlow et al. ..... A63B 57/40 473/175
7,226,361 B2 * 6/2007 Garske ..... A63B 57/40 473/175

FOREIGN PATENT DOCUMENTS

JP H0613867 U * 2/1994

* cited by examiner

*Primary Examiner* — Christopher J Sebesta
*Assistant Examiner* — Joel F. Mitchell
(74) *Attorney, Agent, or Firm* — Adrian D. Battison; Ade & Company Inc.; Ryan W. Dupuis

(57) ABSTRACT

A golf cup is installed in artificial turf which includes an aggregate base with a hole in the base by inserting an additional sleeve in the hole so that the sleeve is held in place against side to side movement and at a fixed height by engagement with the aggregate. The upper circular edge of the sleeve is positioned at the level top prepared surface of the aggregate. A layer of artificial turf is applied over the level top prepared surface and over the hole and the sleeve and an opening is cut matching the inside diameter of the sleeve. A cup portion is inserted into the sleeve and engages a stop shoulder in the sleeve so that an upper lip of the cup portion stands above the upper circular edge of the sleeve by a distance substantially equal to a thickness of the backing layer of the turf.

1 Claim, 1 Drawing Sheet

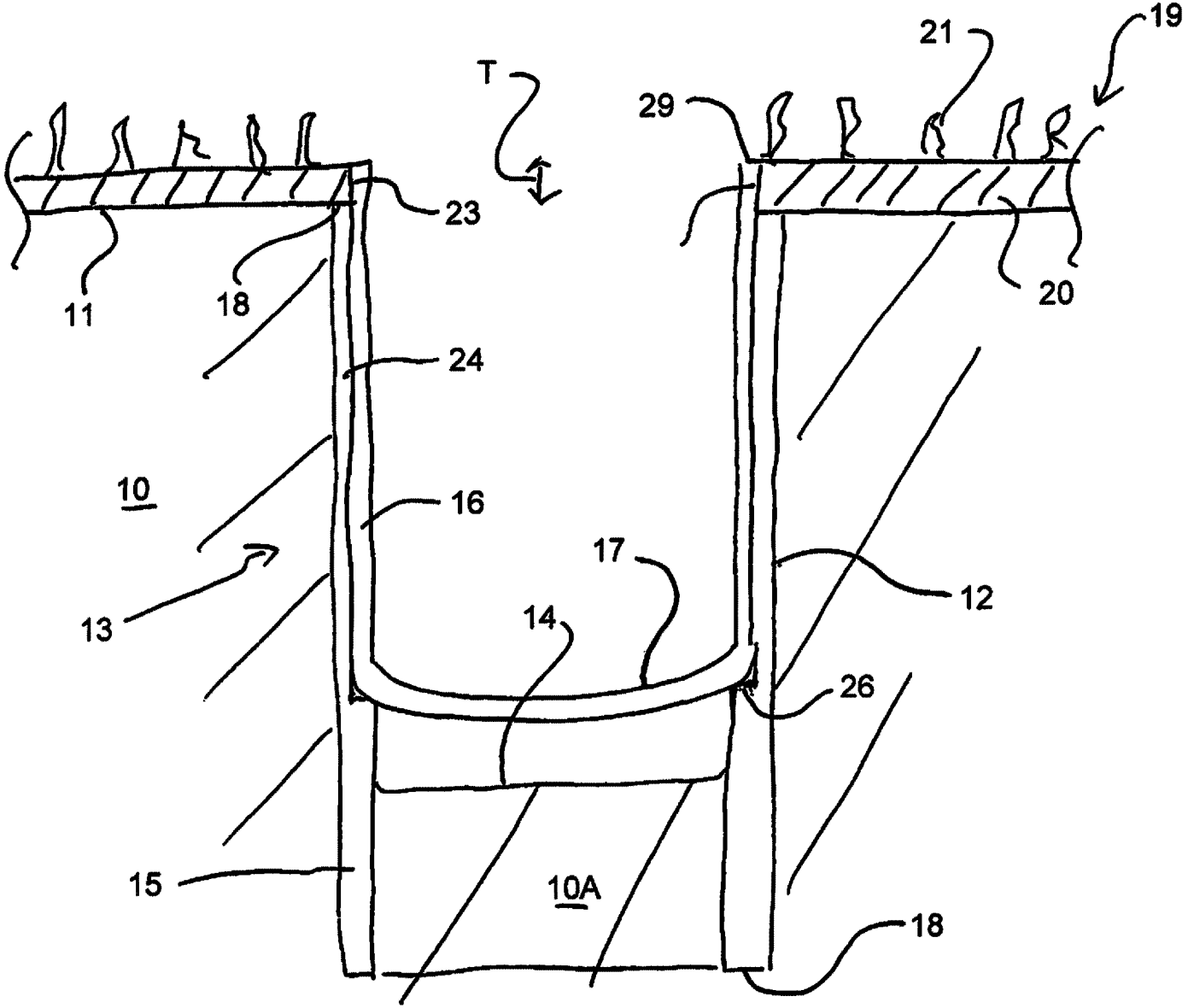
19
20
21
29
T
23
18
11
24
16
10
12
26
17
14
13
10A
18
15

GOLF CUP CONSTRUCTION FOR USE WITH ARTIFICIAL TURF

This invention relates to a golf cup construction for use with artificial turf.

BACKGROUND OF THE INVENTION

For use with conventional grass, a golf cup is simply slid into a drilled hole in the surface which can be moved easily to a new location by drilling a new hole. However this arrangement when used on artificial turf is unsatisfactory and the cup can regularly become loose and cannot easily be moved.

U.S. Pat. No. 3,643,944 (Boyes) discloses a golf cup retaining holder including an inner cup and an outer supporting sleeve which vents the area beneath an artificial green to the atmosphere. The retaining holder also serves to lock the green to the subsurface in the area of the hold and also provides a golf cup of the character which provides a ball holder that precludes the golf ball from dropping to the bottom when it is dropped in the cup and also permits drainage of water into the subsoil below the level of the clay base.

U.S. Pat. No. 6,508,719 (Reddick) discloses golf cup retaining system for artificial greens which includes a prepared surface, a base and a sheet of artificial turf. The retaining system comprises a plastic retaining tube with one end embedded in the prepared surface below the base with its upper end substantially aligned with the upper surface of the base. The artificial turf is positioned over the base and over the upper end of the retaining tube. Segments of the artificial turf extend into the opening at the upper end so that they are trapped between the inner cup and the outer sleeve.

These arrangements however fail to provide a simple system which properly locates the cup with the top lip of the cup at a required height.

SUMMARY OF THE INVENTION

According to the invention there is provided a method for installing a golf cup in artificial turf comprising:

- forming an aggregate base which includes a level top prepared surface;
- forming a hole in the base to a depth to receive a golf cup;
- inserting a sleeve in the hole as a friction fit so that the sleeve is held in place against side to side movement by engagement with the aggregate surrounding the hole;
- locating the sleeve so that an upper circular edge of the sleeve is positioned at the level top prepared surface;
- applying a layer of artificial turf over the level top prepared surface and over the hole and the sleeve, the turf having a backing layer and a covering attached to the backing layer of artificial grass;
- forming an opening in the artificial turf at the hole with an outer edge of the opening at the sleeve;
- inserting a cup portion into the sleeve;
- and locating a height of the cup in the sleeve so that an upper lip of the cup portion stands proud of the upper circular edge of the sleeve by a distance substantially equal to a thickness of the backing layer.

Preferably the opening is cut matching the inside diameter of the sleeve so that the outer edge of the opening in the backing layer overlies the upper circular edge of the sleeve and the outside surface of the cup between the edge of the sleeve and the upper lip of the cup engages an inside edge of the backing layer at the opening.

Preferably the sleeve is circular cylindrical so as to have no flange at the upper end and also the cup portion is circular cylindrical so as to have no flange at the upper end. That is the sleeve is held in place by its engagement with the aggregate and the cup is held in place by the engagement with the sleeve. There is no need therefore for any flanges to provide a locating action. This does not preclude a non-locating out-turned lip at the top of the cup typically or often provided for additional strength at the exposed edge.

Preferably the sleeve is longer than the cup portion so that a lower portion of the sleeve extends beyond the cup into the aggregate.

Preferably the sleeve has a shoulder at a position spaced from the upper edge by a distance to engage a bottom portion of the cup portion and to hold the cup portion at said height.

BRIEF DESCRIPTION OF THE DRAWINGS

One embodiment of the invention will now be described in conjunction with the accompanying drawings in which:

FIG. 1 is cross-sectional view through an installed golf cup located in an aggregate material underlying a layer of artificial turf a according to the present invention. The method steps are clear from the installed illustration.

In the drawings like characters of reference indicate corresponding parts in the different FIGURES.

DETAILED DESCRIPTION

The method for installing a golf cup in artificial turf is clear from the installation shown in FIG. 1 which is defined by an aggregate base 10 which includes a level top prepared surface 11 with a cylindrical hole 12 in the base 10 drilled to a depth 14 to receive a golf cup 13.

The golf cup includes a cylindrical sleeve 15 and an inner conventional golf cup portion 16. The cup portion is of a typical construction with a base 17 and insert portions for confining the ball and openings for drainage. These are not shown as they are not relevant here.

The outer cylindrical sleeve 15 is inserted in the hole as a friction fit so that the sleeve is held in place against side to side movement by engagement with the aggregate surrounding the hole and is held at a fixed height by engagement of a lower end portion of 18 of the sleeve into the aggregate 10A at the bottom of the hole.

The sleeve is inserted into the aggregate to a depth so that an upper circular edge of the sleeve is positioned accurately aligned at the level top prepared surface 11 and so that none of the sleeve projects above the surface.

A layer 19 of artificial turf includes a base layer 20 typically of a thick plastics material of the order of 5 mm in thickness and a tufted or attached layer of artificial grass 21 applied over the backing layer 20. Again the method of attachment and the construction of the artificial turf is well known and not relevant here.

The layer 19 is applied over the level top prepared surface and over the hole and the sleeve. The hole can then be located manually by feeling through the turf layer to the hole and an opening 22 is cut carefully in the artificial turf at the hole with an outer edge 23 of the opening, that is the cylindrical cut edge of the backing layer, being located accurately at or aligned with the inside surface 24 of the sleeve.

The cup portion 16 is then slid into the sleeve as a friction fit down to a position where a bottom portion of the cup engages a shoulder 26 formed in or cut in the sleeve. In one embodiment the sleeve can be a simple plastic pipe which is turned to form an inside diameter matching the outside of the cup portion and a shoulder at the required height.

The height of the cup in the sleeve is located by the shoulder so that an upper lip 29 of the cup portion stands proud of the upper circular edge 18 of the sleeve by a distance substantially equal to the thickness of the backing layer which can be 5 mm as set out above.

As the opening is cut accurately matching the inside diameter of the sleeve, the outer edge of the opening, defined by the cut edge of the backing layer, overlies the upper circular edge 18 of the sleeve and the outside surface of the cup 16 between the edge 18 of the sleeve and the upper lip 29 of the cup engages an inside edge of the backing layer at the opening locating it in place and properly positioning the height of the top edge of the cup directly at the top surface of the backing layer.

Both the sleeve and the cup are directly circular cylindrical so as to have no mounting or coupling flange at the upper end.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for installing a golf cup in artificial turf comprising:

forming a base layer of an aggregate which includes a level top prepared surface;

forming a hole in the aggregate to a depth to receive a golf cup;

inserting a sleeve in the hole as a friction fit so that the sleeve is held in place against side to side movement by engagement with the aggregate surrounding the hole;

wherein the sleeve is circular cylindrical along its whole length with an outer cylindrical surface and an inner cylindrical surface with an upper edge between the outer cylindrical surface and the inner cylindrical surface;

locating the sleeve so that the upper edge of the sleeve is positioned at the level top prepared surface;

applying a layer of the artificial turf over the level top prepared surface and over the hole and the sleeve, the artificial turf having a backing layer and a covering attached to the backing layer of the artificial turf;

cutting an opening in the artificial turf at the hole with a cylindrical cut edge of the backing layer at the opening being located at the sleeve;

wherein the cylindrical cut edge of the backing layer overlies the upper edge of the sleeve;

wherein the cylindrical cut edge of the backing layer is aligned with the inner cylindrical surface of the sleeve;

providing a cup portion with a circular cylindrical outside surface with an upper edge of the cup portion at the circular cylindrical outside surface;

inserting the cup portion into the sleeve with the circular cylindrical outside surface of the cup portion at the inner cylindrical surface of the sleeve in engagement therewith;

locating a height of the cup portion in the sleeve by a locating element in the sleeve which engages the cup portion so that the upper edge of the cup portion stands above the upper edge of the sleeve by a distance substantially equal to a thickness of the backing layer;

and maintaining the cylindrical cut edge of the backing layer in place by engagement of the cylindrical cut edge against the circular cylindrical outside surface of the cup portion at the upper edge of the cup portion.

* * * * *